US006275652B1

(12) United States Patent
Chauviaux

(10) Patent No.: US 6,275,652 B1
(45) Date of Patent: Aug. 14, 2001

(54) HEATING ELEMENT FOR A HUMIDIFIER

(75) Inventor: Gabriel Chauviaux, Quebec (CA)

(73) Assignee: The Holmes Group, Inc., Milford, MA (US)

( * ) Notice: Subject to any disclaimer, the term of this patent is extended or adjusted under 35 U.S.C. 154(b) by 0 days.

(21) Appl. No.: 09/552,851

(22) Filed: Apr. 20, 2000

Related U.S. Application Data

(60) Provisional application No. 60/147,984, filed on Aug. 9, 1999.

(51) Int. Cl.[7] ..... A61H 33/12

(52) U.S. Cl. ..... 392/405; 261/142

(58) Field of Search ..... 361/142, 81; 392/401, 392/402, 405, 325, 406, 501; 236/446; 600/22

(56) References Cited

U.S. PATENT DOCUMENTS

| | | | | |
|---|---|---|---|---|
| 3,806,102 | * | 4/1974 | Valenta et al. | 261/142 |
| 3,873,806 | * | 3/1975 | Schossow | 392/402 |
| 4,139,762 | * | 2/1979 | Pohrer et al. | 392/402 |
| 4,563,313 | * | 1/1986 | Tsuaki | 361/81 |
| 4,697,735 | * | 10/1987 | Temple | 236/44 C |
| 5,210,818 | * | 5/1993 | Wang | 392/405 |
| 5,242,375 | * | 9/1993 | McDonough | 600/22 |
| 5,313,550 | * | 5/1994 | Grosnier et al. | 392/325 |
| 5,339,383 | * | 8/1994 | Marino | 392/406 |
| 5,343,551 | * | 8/1994 | Glucksman | 392/405 |
| 5,483,616 | * | 1/1996 | Chiu et al. | 392/406 |
| 5,688,446 | * | 11/1997 | Glenn | 261/142 |
| 5,835,680 | * | 11/1998 | Glucksman et al. | 392/501 |
| 5,943,473 | * | 8/1999 | Levine | 392/401 |
| 6,052,511 | * | 4/2000 | Birdsell | 392/406 |

* cited by examiner

*Primary Examiner*—Teresa Walberg
*Assistant Examiner*—Leonid Fastovsky
(74) *Attorney, Agent, or Firm*—Hoffmann & Baron, LLP; Francis E. Marino

(57) ABSTRACT

A heating element for use in a portable humidifier is provided, which is at least partially disposed within a tray of water within the humidifier. The heating element includes a mounting portion, a leg portion and a foot portion. The mounting portion is coupled to the housing and an tipper end of the leg portion, which extends vertically downward from the mounting portion. The foot portion is coupled to a lower end of the leg portion, and extends horizontally therefrom. The leg portion is elongated and separates the mounting portion and the foot portion. The foot portion is shaped such that a line from the upper surface to the lower surface must pass through a perimeter of the heating element when viewed from above. A bottom surface of the foot portion is curved or slanted upward from a nadir to the perimeter of the heating element.

45 Claims, 8 Drawing Sheets

HEATING ELEMENT FOR A HUMIDIFIER

CROSS-REFERENCE TO RELATED APPLICATION

This application is based on and claims priority to U.S. Provisional Patent Application Ser. No. 60/147,984, which was filed on Aug. 9, 1999, the disclosure of which is incorporated herein by reference.

BACKGROUND OF THE INVENTION

1. Field of the Invention

The field of the invention relates to humidifiers for generating steam, and more particularly relates to heating elements used in such humidifiers.

2. Brief Description of the Related Art

Humidifiers are commonly used in residential and commercial settings to increase the level of humidity in the air for various purposes, such as health, safety and reliability. For instance, it has been found that increased humidity reduces the amount of recuperation time required for upper respiratory infections. In addition, increased humidity reduces the amount of static charge which can build up on electrostatic sensitive devices, such as semiconductors and integrated circuits.

After operating a humidifier for a period of time, the components of the humidifier must typically be cleaned in order to control bacterial growth and remove mineral deposits. Mineral deposits caused by excess minerals in solution, such as calcium in the water used to generate steam is a problem, particularly when the deposits form on a heating element used to bring the water to a boiling point.

FIGS. 1A and B show a top and side view, respectively, of a heating element of the prior art. This conventional heating element includes a mounting portion 15 and a ring 11 having an open interior section 13. The heating element is suspended in water within a boiling chamber of the humidifier. It has been found that the inner circumference of the ring 11 is particularly susceptible to the deposition of minerals, which in some cases causes a so-called "arch effect" wherein the deposited minerals create arches across the open interior section 13 of the ring 11. These arches are particularly difficult to remove by the user, and removal often mars the external finish of the heating element such that additional minerals are deposited more quickly and are even more difficult to remove.

Some of the conventional heating elements include a flattened bottom surface, which becomes a collection point for small air bubbles that are created along a lower surface of the boiling chamber and float upwards as the water is boiled. As the smaller bubbles combine to form larger bubbles under the flattened bottom surface of the heating element, these larger bubbles eventually escape and float to the top of the boiling chamber creating an undesirable noise to the user upon bursting at the top of the boiling chamber. In addition, as the larger air bubbles burst, water droplets are projected onto additional surfaces surrounding the boiling chamber. These droplets leave additional mineral deposits or scaling upon evaporating.

Still other heating elements have a horizontally disposed lower portion that transfers excessive heat from the heating element to the remaining components of the humidifier. Since in most cases much of the remaining components are either plastic or not suitable for operating at high temperatures, this creates an undesirable and often dangerous situation. In addition, the proximity between the horizontally disposed portion and the mounting portion of the heating element provides restricted cavities which are prone to mineral deposits.

Therefore, it would be advantageous if a heating element could reduce the amount of mineral deposits on and around the heating element and/or reduce the noise created by air bubbles which collect underneath the heating element.

SUMMARY OF THE INVENTION

A humidifying apparatus formed in accordance with the present invention includes a housing, a tray for holding water and a heating element. The heating element is at least partially disposed within the tray and includes a mounting portion, a leg portion and a foot portion. The mounting portion is coupled to the housing and an upper end of the leg portion of the heating element. The leg portion extends substantially vertically downward from the mounting portion into the tray. The foot portion is coupled to a lower end of the leg portion and extends substantially horizontally therefrom.

The leg portion is elongated and separates the mounting portion and the foot portion, which reduces mineral deposition on the heating element. The foot portion is shaped such that a line from the upper surface to the lower surface must pass across a perimeter of the heating element when viewed from above. The bottom surface of the foot portion is preferably convex, partially spherical or curved upward from a nadir to the perimeter of the heating element.

The humidifying apparatus formed in accordance with the present invention can also include a gasket disposed around a cylindrical portion of the heating element located above a flange on the heating element. The gasket provides a seal between the heating element and the housing when the heating element is affixed thereto. The gasket includes an upper annular ring, a central annular ring, a lower annular ring and a side cross-sectional profile. The central annular ring is coupled to the upper annular ring and has a perimeter which is less than the perimeter of the upper annular ring. The lower annular ring is coupled to the central annular ring and has a perimeter which is about the same as the perimeter of the upper annular ring. Each of the annular rings have an inner circumference which is substantially the same, and defines a vertical conduit of substantially constant diameter extending through the gasket.

The heating element is disposed within the conduit of the gasket, and the annular rings are coupled such that the perimeter of the annular rings are substantially concentric when viewed from above. A side cross-sectional profile of the gasket substantially conforms to a side cross-sectional profile of the housing surrounding the heating element. A heating element having the features described above is also provided in accordance with the present invention.

A preferred form of the heating element and a humidifier including the heating element of the present invention, as well as other embodiments, objects, features and advantages of this invention will be apparent from the following detailed description of illustrative embodiments thereof, which is to be read in connection with the accompanying drawings.

DETAILED DESCRIPTION OF THE INVENTION

Figure 1B:
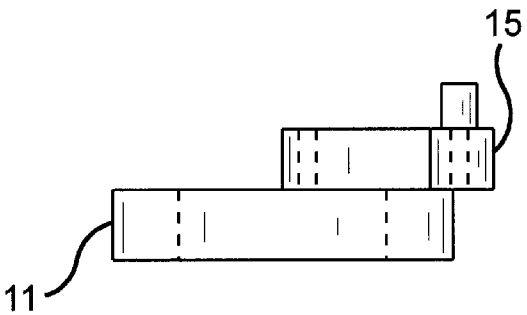
FIG. 1B PRIOR ART
FIGS. 1A and 1B are top and side views, respectively, of a ring-shaped heating element of the prior art.
Figure 1A:
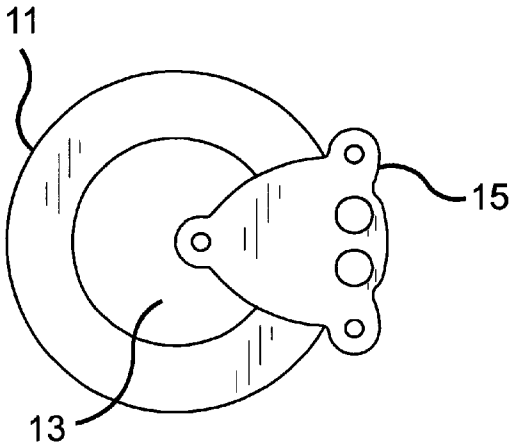
FIG. 1A PRIOR ART
Figure 2:
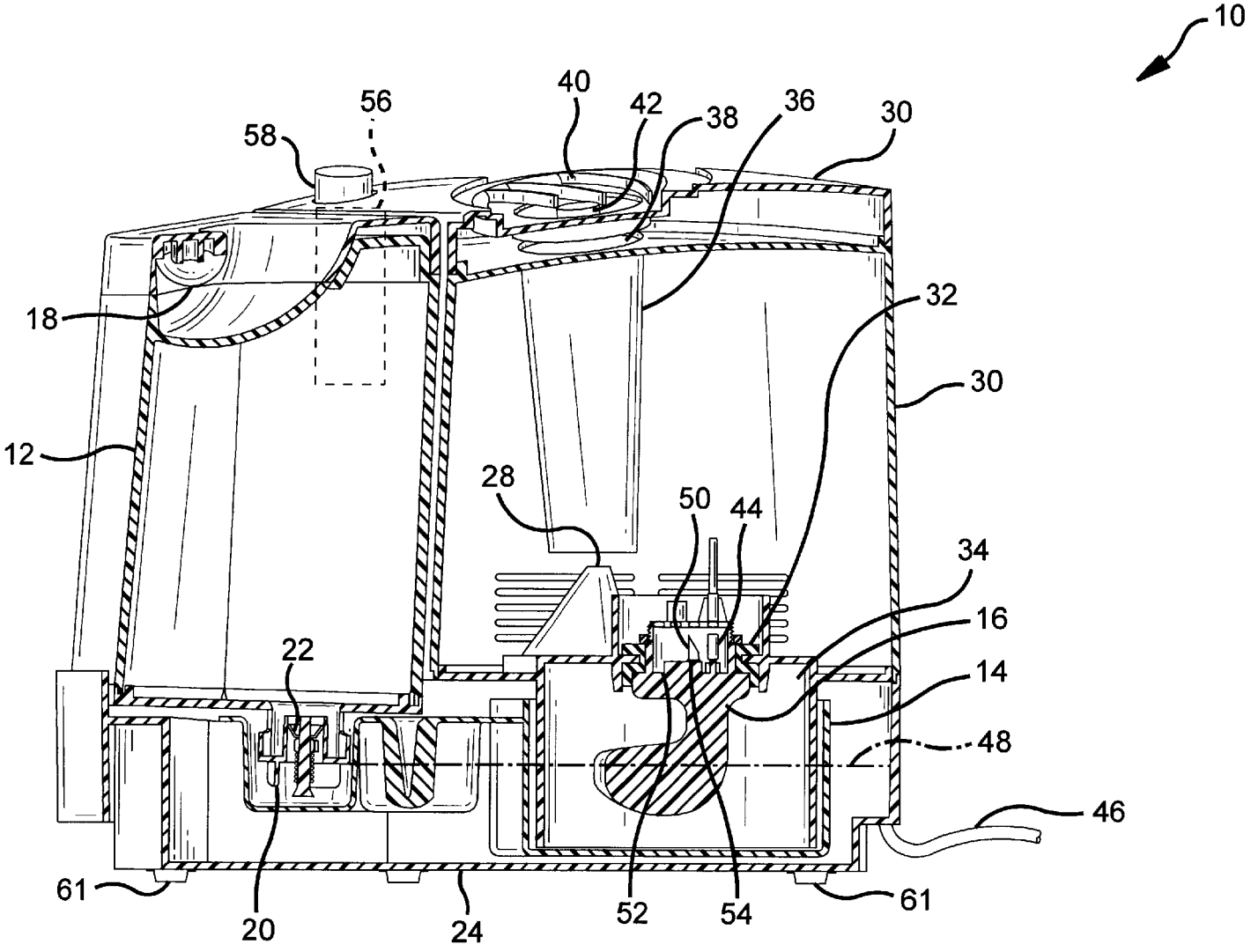
FIG. 2 is a cross-sectional view of a humidifier employing a heating element formed in accordance with the present invention.

FIG. 2 shows a portable humidifier 10 for use in the home, the office, or other suitable location. The humidifier includes a water tank 12, a tray 14 or other suitable receptacle for receiving water from the tank, and a heating element 16 positioned within the tray. The water tank 12 is preferably removable to facilitate refilling and/or cleaning. A handle 18 is accordingly provided near the top of the tank, and may be integral with the tank. A tank cap 20 is mounted to the tank to enable filling of the contents thereof. Therefore, the tank cap 20 is preferably removable. While the tank 12 is preferably cleanable and reusable, a disposable tank could alternatively be employed.

A conventional tank valve 22 or other suitable means are provided for releasing water from the tank in a controlled manner. Tank valves are well known to the art, and are employed in commercially available humidifiers of various types. While more sophisticated water delivery means, such as a pump, could be employed, tank valves are economic and reliable for use in the consumer market.

The tray 14 is positioned within a base 24. The base includes bottom and side walls which together define an enclosure for the tray 14 and other elements of the humidifier. As shown in greater detail in FIG. 3, an elongate, tortuous channel 26 is provided within the base 24. One end 26A of the channel is positioned beneath the taik valve 22. The other end 26B of the channel is in fluid communication with the tray 14., which has an opening in a side wall thereof for admitting water into the tray from the channel. The use of the tortuous channel 26 is preferred in order to substantially confine the hot water within the tray 14. Backflow through the tortuous path is very limited. The tray 14 and the channel 26 are both preferably removable from the base 24 to facilitate cleaning.

Figure 3:
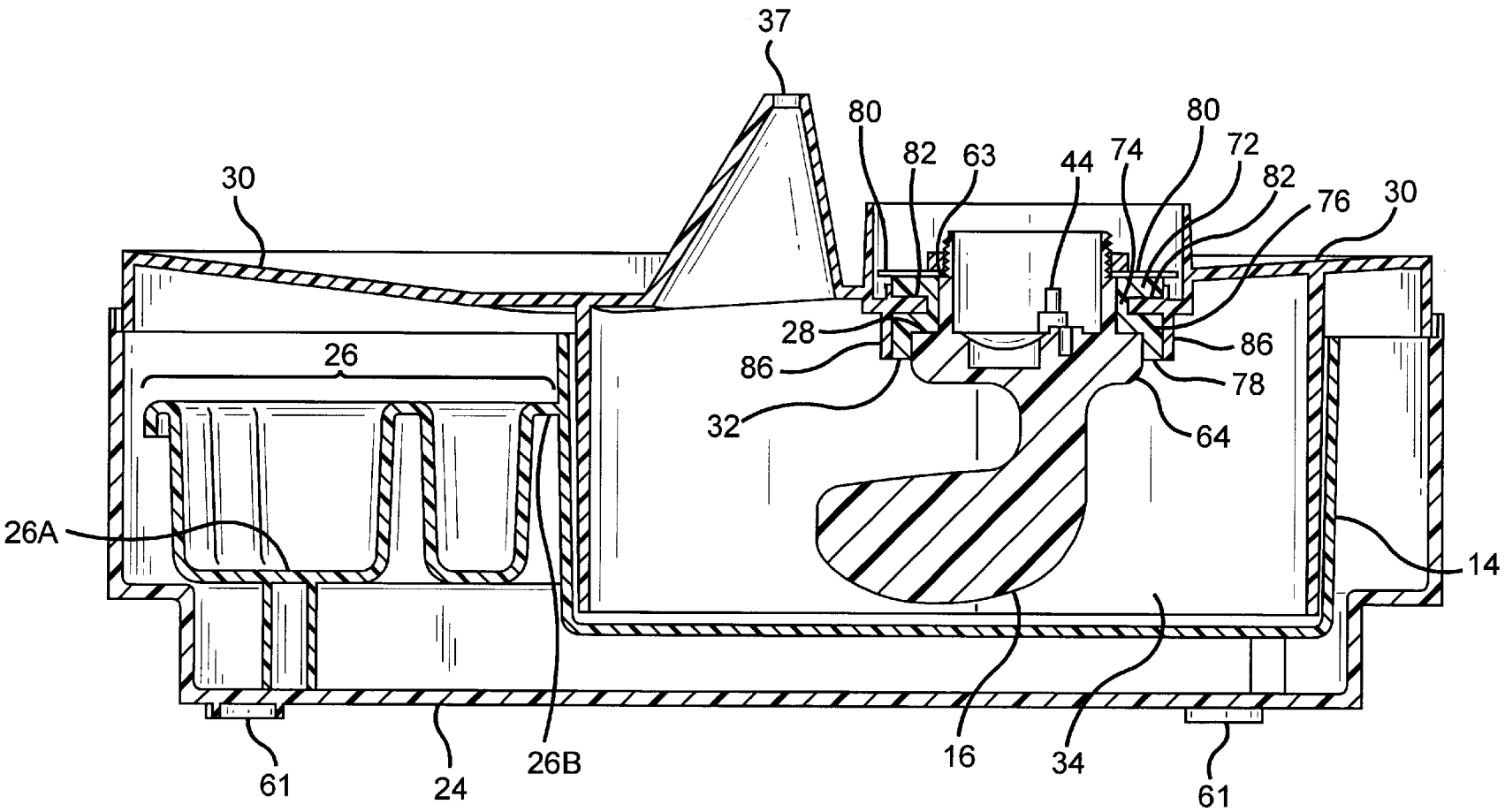
FIG. 3 is an enlarged side cross-sectional view of a bottom portion of the humidifier shown in FIG. 2.

Referring again to FIG. 3, a housing 30 is seated on the tray 14. The housing 30 provides support for the heating element 16 which is preferably secured to the bottom of the housing 30 by screwing the heating element 16 into an opening in the bottom of the housing 30. As shown in FIG. 3, a gasket 32 is inserted between the heating element 16 and the housing 30, which provides for a water-tight seal between a boiling chamber 34 formed between the bottom of the housing 30 and the tray 14. In addition, glue 28, a sealant, or the like is preferably distributed between the gasket 32 and the housing 30, and between the gasket 32 and the heating element 16 to further ensure that water will not enter the housing 30 from the boiling chamber 34 and that mineral deposits will not collect between the heating element 16 and the gasket 32.

As shown in FIG. 2, an evaporator 36 is attached to an interior surface of the housing 30 near the top of the housing 30. The evaporator 36 functions to guide the steam which results from water being boiled in the boiling chamber 34 through the housing 30 and out an outlet 38 at the top of the housing 30. The outlet 38 is covered by an outlet grill 40, which can preferably be used to both direct the steam as well as protect users from the interior of the housing 30. Preferably, the outlet grill 40 is removable, which allows an optional medicine cup 42 to be seated over the outlet 38 and under the outlet grill 40. The medicine cup 42 holds medication, and when the steam is passed over and around the medicine cup 42, the medicine therein is heated, evaporated and joins with the steam as it escapes through the outlet 38.

The heating element 16 has two electrodes 44 which are an electrical connection with a positive line and a return line of a power cord 46. When the power cord 46 is plugged in, current passes between the electrodes 44 which creates heat in the heating element 16. The heating element 16 is preferably a thermal and electrical conductor, such as a metal. If the water in the boiling chamber 34 is maintained at a minimum water level 48, the heat created by the heating element 16 is transferred to the water. When the water reaches a boiling point, the resulting steam rises upward and passes through a conduit 28 in the bottom of the housing 30 and is guided by the evaporator 36 to the outlet 38. An optional thermo-fuse 50 is electrically connected in series between one of the electrodes 44 and one of the lines of the power cord 46. The thermo-fuse 50 disconnects or open-circuits the corresponding electrode 44 from the power cord 46 when a signal from a thermostat 52 indicates that the temperature of the heating element 16 has exceeded a maximum pre-determined threshold considered to be safe. The thermostat 52 is seated in the heating element 16 and continuously monitors the temperature thereof. The thermo-fuse 50 is positioned above and is removably affixed to the heating element 16 by a clip 54.

An optional humidistat 56 is affixed to the top of the interior surface of the housing 30, and extends through an opening therein. The humidistat 56 monitors the level of moisture in the air surrounding the humidifier 10 and interrupts the power supplied to the electrodes 44 from the power cord 46 upon reaching a desired level of humidity preferably set by the user. The user can modify the desired level of humidity by adjusting a knob 58 located on top of the humidistat 56. Rubber feet 61 located on the bottom of the humidifier 10 function to provide a stable base for the humidifier 10 on a variety of surfaces.

The humidifier may be equipped with a microprocessor or other electronics for controlling its operation. The options of manual and automatic operation are preferably, though not necessarily, provided. Displays showing power on, high and/or low modes or operation, and humidity are also preferred. Use of the humidistat 56 allows automatic operation of the humidifier. In the automatic mode, the user would set the desired humidity. If the room humidity is less than the desired humidity level, the heating element 16 would be powered until the humidity reaches the set level. Whether used manually or automatically, power to the heating element 16 is shut off when the water tank 12 is below a preselected level or empty. Additionally or alternatively, a water gauge or separate float in the tank 12 and/or tray 14 may be provided in conjunction with a switch for the purpose of shutting off power to the heating element 16 under low water level conditions. Such float/switch assemblies have been used in prior art warm mist humidifiers.

Figure 4C:
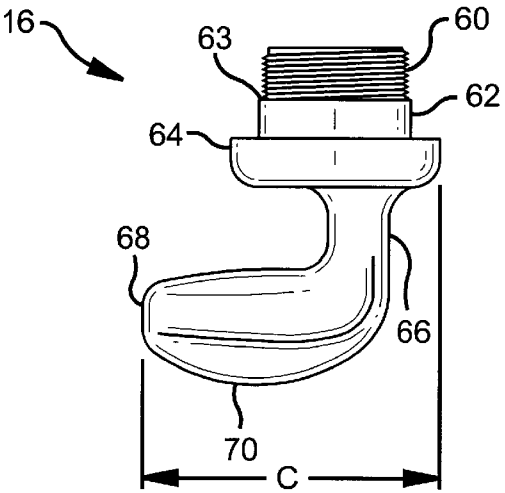
FIG. 4C is a side view of the heating element formed in accordance with the present invention.
Figure 4B:
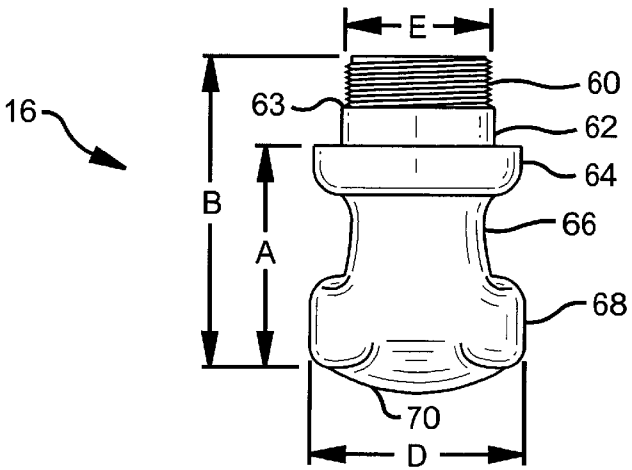
FIG. 4B is a rear view of the heating element formed in accordance with the present invention.
Figure 4A:
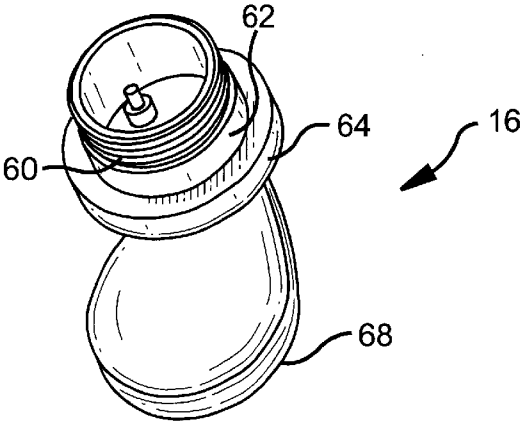
FIG. 4A is a top isometric view of the heating element formed in accordance with the present invention.

A top isometric view, a rear view and a side view of the heating element 16 are shown in FIGS. 4A, 4B and 4C, respectively. The heating element 16 includes an upper threaded portion 60 which is screwed into the bottom of the housing 30; an upper cylindrical portion 62 around which the gasket 32 is positioned; a flange 64 against which the gasket 32 is seated; a vertical portion or leg 66; and a horizontal portion or foot 68. The heating element 16 is preferably manufactured from an integral piece of solid metal such as aluminum. The upper threaded portion 60 extends vertically upward from and is coupled to the upper cylindrical portion 62, which extends vertically upward from and is coupled to the flange 64. The upper cylindrical portion 62 includes a shoulder 63, which protrudes radially beyond the upper threaded portion 66. The leg 66 extends downward from and is coupled to the flange 64 on an opposing side of the flange 64 from the upper cylindrical portion 62. The foot 68 extends horizontally from and is coupled to a lower portion of the leg 66.

The leg 66 is elongated, which represents an improvement over heating elements of the prior art since such a leg 66 enables greater separation between the flange 64 and the foot 68. This greater separation reduces the amount of mineral deposits on and the flange 64 and the foot 68. Such separation also positions the mass of the foot 68 at a greater distance from the bottom of the housing 30 such that less heat is transferred from the foot 68 to the remaining elements of the humidifier including the gasket 32. In the preferred embodiment, a dimension A, shown in FIG. 4B from a bottom surface 70 of the foot 68 to a top of the flange 64, is preferably about 2.25 inches, and a dimension B, from a top of the threaded portion 60 to the bottom 70 of the foot 68, is preferably about 3.00 inches. Also, in the preferred embodiment, a dimension C from an outer circumference of the flange 64 to a front or toe of the foot 68 shown in FIG. 4C, is preferably about 2.95 inches, and a dimension D, being a width of the foot 68 as shown in FIG. 4B, is preferably about 2.10 inches. A dimension E, being a diameter of the upper threaded portion 60 shown in FIG. 4B, is preferably about 1.50 inches. It is anticipated that the dimensions provided above preferably remain in substantially the same proportion to each other if the size of the heating element 16 is changed.

The foot 68 represents an improvement over heating elements in the prior art in that the foot 68 provides a continuous surface on all sides without an aperture which passes from a top surface to the bottom surface of the heating element 16. Many of the conventional heating elements, such as those that are ring-shaped, have an inner circumference which is prone to mineral deposits that are extremely difficult to remove during cleaning. In addition, the mineral deposits within the ring often create an "arch effect" wherein the minerals bridge across the ring at numerous locations. Removal of these deposits typically results in permanent damage to the surface of the heating element 16 that renders the heating element even more prone to further buildup of minerals.

A bottom surface 70 of the foot 68 is curved, which also represents an improvement over heating elements in the prior art. It was found that a foot having a flat bottom surface provided an area for the collection of small air bubbles, which were generated along the lower surface of the boiling chamber 34 as the water boiled. The small air bubbles combined to form larger air bubbles, which escaped around the outer perimeter of the foot and created an undesirable popping noise upon reaching the top of the boiling chamber 34. The curvature of the bottom surface 70 of the foot 68 prevents the collection of these air bubbles. Thus, the smaller air bubbles reach the top of the boiling chamber 34 in substantially the same size, and do not create an unacceptable amount of noise upon bursting.

Figure 4E:
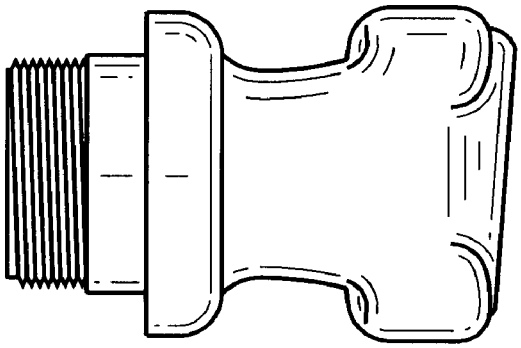
FIG. 4E is a rear view of an alternative embodiment of the heating element formed in accordance with the present invention.
Figure 4D:
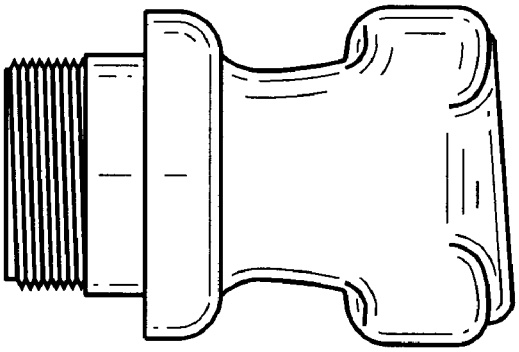
FIG. 4D is a rear view of an alternative embodiment of the heating element formed in accordance with the present invention.
Figure 4G:
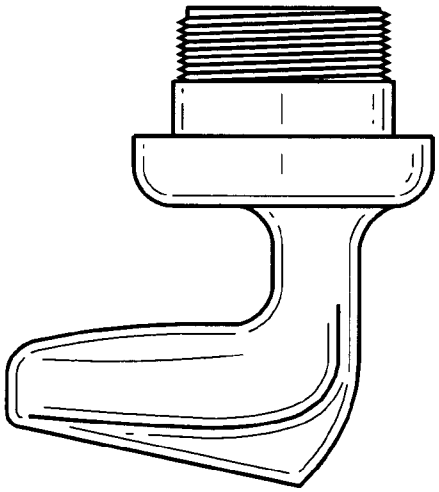
FIG. 4G is a side view of an alternative embodiment of the heating element formed in accordance with the present invention.
Figure 4F:
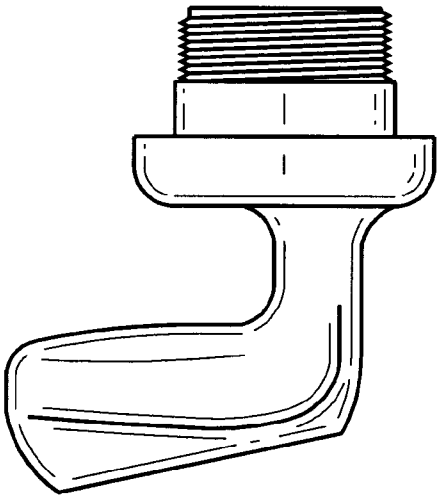
FIG. 4F is a side view of an alternative embodiment of the heating element formed in accordance with the present invention.

In the preferred embodiment of the invention, the bottom surface 70 is substantially convex between a front (or toe) and a rear (or heel) portion of the foot 68 as shown in FIG. 4C and/or substantially convex between a right and a left side of the foot 68 when viewed from the rear of the heating element as shown in FIG. 4B. Alternatively, the bottom surface 70 can be slanted substantially upward or downward from a left side to a right side of the foot 68 as shown in FIGS. 4D and 4E, respectively. In addition, the bottom surface 70 can be slanted substantially upward or downward from the front to the rear of the foot 68 as shown in FIGS. 4F and 4G, respectively. Substantially any shape of the bottom surface 70, which does not cause the air bubbles to collect under the heating element 16, or which promotes the rolling off of air bubbles is considered to be within the scope of the present invention.

Figure 5B:
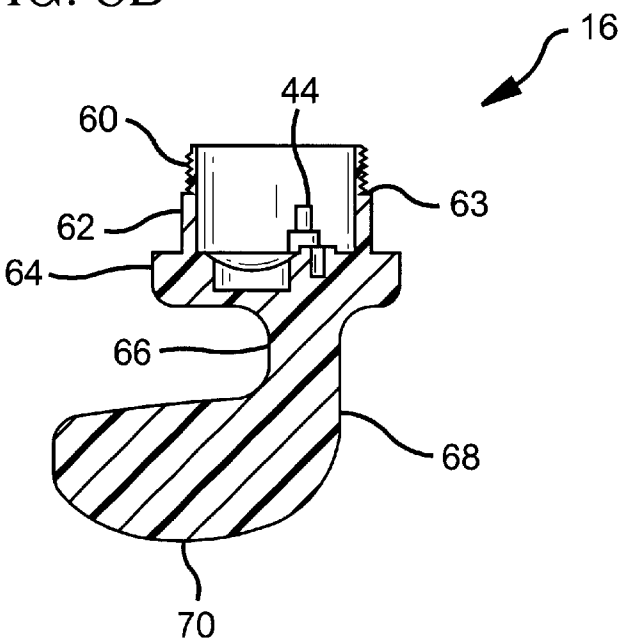
FIG. 5B is a cross-sectional view of the heating element shown in FIG. 5A taken along the cross-section line AA.
Figure 5A:
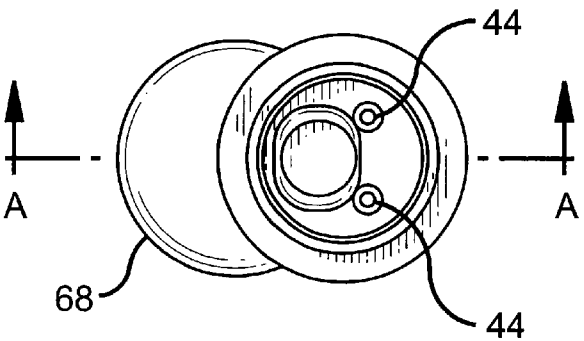
FIG. 5A is a top plan view of the heating element formed in accordance with the present invention showing a cross-section line AA.

FIG. 5A shows a top plan view of the heating element 16 through which a cross-section line AA has been drawn. A cross-sectional view of the heating element 16 is shown in FIG. 5B taken along the cross-section line AA. The heating element 16 is preferably manufactured from a substantially solid piece of metal which is resistant to corrosion, such as aluminum.

Figure 6C:
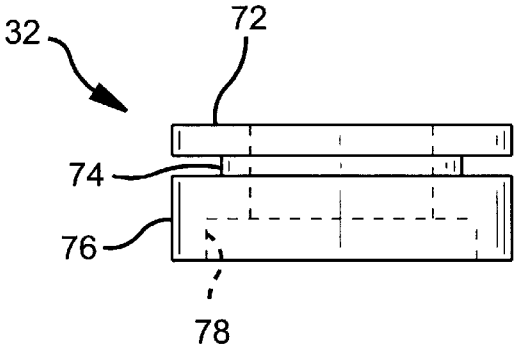
FIGS. 6A, 6B and 6C are bottom, top and side views of a gasket which provides a seal between the heating element and remaining components of the humidifier.
Figure 6B:
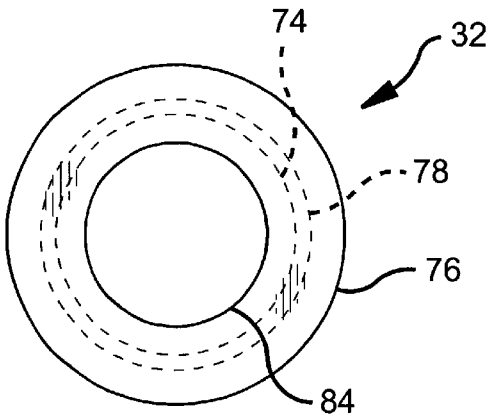
Figure 6A:
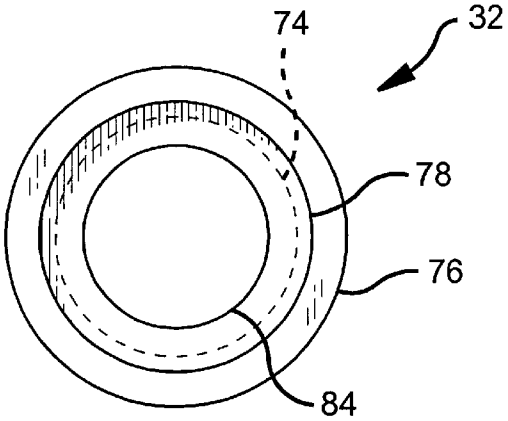

As shown in FIGS. 6A, 6B and 6C, the gasket 32 includes an upper annular ring 72, a central annular ring 74 and a lower annular ring 76 having a circumferential lip 78. As shown in FIG. 3, the upper annular ring 72 is positioned between a sealing compression washer 80 located at the bottom of the housing 30, and a circumferential shoulder 82 integral with the bottom of the housing 30 and protruding from the housing 30 located under the sealing compression washer 80. The shoulder 63 of the upper cylindrical portion 62 comes into contact with or bottoms out against the sealing compression washer 80, and thus limits the compression of the gasket 32 to a constant amount. Stated differently, the action of the solid shoulder 63 coming into contact with the solid sealing compression washer 80 provides a constant compression of the gasket 32. The constant compression of the gasket 32 ensures that the gasket 32 will not be overly compressed, which would eventually decrease the resiliency of the gasket 32, and thus the ability of the gasket 32 to create a water-tight seal. The constant compression of the gasket 32 also ensures that the gasket 32 will be compressed enough to maintain the water-tight seal between the heating element and the bottom of the housing 30.

The upper, central and lower annular rings 72, 74, 76 are preferably manufactured as an integral unit, and follow the contour of the shoulder 82 creating a water-tight seal between the flange 64 of the heating element 16 and the bottom of the housing 30. The heating element 16 is placed through a central conduit 84 in the gasket 32 and is screwed into the bottom of the housing 30. The action of the heating element 16 being screwed into the housing 30 creates a force which compresses the lower annular ring 76 of the gasket 32 between the flange 64 of the heating element 16 and the shoulder 82. This force also compresses the circumferential lip 78 of the gasket 32 between the flange 64 and a vertically downward protruding portion 86 of the shoulder 82 as shown in FIG. 3.

While there have been described what are presently believed to be the preferred embodiments of the invention, those skilled in the art will realize that various changes and modifications may be made to the invention without departing from the spirit of the invention.

What is claimed is:

1. A humidifying apparatus comprising:

a housing;

a tray for holding water, the tray disposed in proximity to the housing; and a heating element, the heating element positioned at least partially within the tray, the heating element including a mounting portion, a leg portion and a foot portion, the mounting portion being coupled to the housing, the leg portion having an upper end and a lower end, the mounting portion being coupled to the upper end of the leg portion, the leg portion extending substantially vertically downward from the mounting portion, the foot portion being coupled to the lower end of the leg portion and extending substantially horizontally therefrom, the leg portion being elongated and separating the mounting portion and the foot portion.

2. A humidifying apparatus as defined by claim 1, wherein the foot portion of the heating element includes an upper surface, a lower surface and a perimeter viewed from above the foot portion, the foot portion being shaped such that a line from the upper surface to the lower surface must pass through the perimeter of the heating element.

3. A humidifying apparatus as defined by claim 1, wherein the foot portion of the heating element includes a bottom surface, the bottom surface being substantially convex.

4. A humidifying apparatus as defined by claim 1, wherein the foot portion of the heating element includes a bottom surface, the bottom surface including a nadir, the bottom surface being curved upward from the nadir to the perimeter of the heating element.

5. A humidifying apparatus as defined by claim 1, wherein the foot portion of the heating element includes a bottom surface, a right side and a left side, the bottom surface being at least one of slanted upward and slanted downward from the left side to the right side.

6. A humidifying apparatus as defined by claim 1, wherein the foot portion of the heating element includes a bottom surface, a toe portion and a heel portion, the bottom surface being at least one of slanted upward and slanted downward from the toe portion to the heel portion.

7. A humidifying apparatus as defined by claim 1, wherein the mounting portion of the heating element includes a threaded portion, the threaded portion being removably coupled to the housing.

8. A humidifying apparatus as defined by claim 1, further comprising a gasket, wherein the mounting portion of the heating element further includes a cylindrical portion and a flange, the flange being coupled to the cylindrical portion and extending substantially vertically downward therefrom, the gasket being disposed around the cylindrical portion above the flange, the gasket providing a seal between the heating element and the housing when the heating element is coupled thereto.

9. A humidifying apparatus as defined by claim 8, wherein the housing includes a side cross-sectional profile, and wherein the gasket includes an upper annular ring, a central annular ring, a lower annular ring, and a side cross-sectional profile, the upper annular ring having a perimeter, the central annular ring being coupled to the upper annular ring and having a perimeter which is less than the perimeter of the upper annular ring, the lower annular ring being coupled to the central annular ring and having a perimeter which is substantially the same as the perimeter of the upper annular ring, each of the annular rings having an inner circumference, the inner circumference of the annular rings being substantially the same and defining a vertical conduit extending through the gasket having a substantially constant diameter through which the cylindrical portion of the heating element is disposed, the annular rings coupled such that the perimeters of the annular rings are substantially concentric when viewed from above, the side cross-sectional profile of the gasket substantially conforming to the side cross-sectional profile of the housing surrounding the heating element.

10. A humidifying apparatus as defined by claim 9, wherein the upper annular ring, the central annular ring and the lower annular ring are integral.

11. A humidifying apparatus comprising:

a housing;

a tray for holding water, the tray disposed in proximity to the housing; and a heating element, the heating element positioned at least partially within the tray, the heating element including a mounting portion, a leg portion and a foot portion, the mounting portion being coupled to the housing, the leg portion having an upper end and a lower end, the mounting portion being coupled to the upper end of the leg portion, the leg portion extending substantially vertically downward from the mounting portion, the foot portion being coupled to the lower end of the leg portion and extending substantially horizontally therefrom, the foot portion including an upper surface, a lower surface and a perimeter viewed from above the foot portion, the foot portion being shaped such that a line from the upper surface to the lower surface must pass through the perimeter of the heating element.

12. A humidifying apparatus as defined by claim 11, wherein the leg portion is elongated and separates the mounting portion and the foot portion.

13. A humidifying apparatus as defined by claim 11, wherein the foot portion of the heating element includes a bottom surface, the bottom surface being substantially convex.

14. A humidifying apparatus as defined by claim 11, wherein the foot portion of the heating element includes a bottom surface and a perimeter when viewed from above, the bottom surface including a nadir, the bottom surface being curved upward from the nadir to the perimeter of the heating element.

15. A humidifying apparatus as defined by claim 11, wherein the foot portion of the heating element includes a bottom surface, a right side and a left side, the bottom surface being at least one of slanted upward and slanted downward from the left side to the right side.

16. A humidifying apparatus as defined by claim 11, wherein the foot portion of the heating element includes a bottom surface, a toe portion and a heel portion, the bottom surface being at least one of slanted upward and slanted downward from the toe portion to the heel portion.

17. A humidifying apparatus as defined by claim 11, wherein the mounting portion of the heating element includes a threaded portion, the threaded portion being removably coupled to the housing.

18. A humidifying apparatus as defined by claim 11, further comprising a gasket, wherein the mounting portion of the heating element further includes a cylindrical portion and a flange, the flange being coupled to the cylindrical portion and extending substantially vertically downward therefrom, the gasket being disposed around the cylindrical portion above the flange, the gasket providing a seal between the heating element and the housing when the heating element is coupled thereto.

19. A humidifying apparatus as defined by claim 18, wherein the housing includes a side cross-sectional profile, and wherein the gasket includes an upper annular ring, a central annular ring, a lower annular ring, and a side cross-sectional profile, the upper annular ring having a perimeter, the central annular ring being coupled to the upper annular ring and having a perimeter which is less than the perimeter of the upper annular ring, the lower annular ring being coupled to the central annular ring and having a perimeter which is substantially the same as the perimeter of the upper annular ring, each of the annular rings having an inner circumference, the inner circumference of the annular rings being substantially the same and defining a vertical conduit extending through the gasket having a substantially constant diameter through which the cylindrical portion of the heating element is disposed, the annular rings coupled such that the perimeters of the annular rings are substantially concentric when viewed from above, the side cross-sectional profile of the gasket substantially conforming to the side cross-sectional profile of the housing surrounding the heating element.

20. A humidifying apparatus as defined by claim 19, wherein the upper annular ring, the central annular ring and the lower annular ring are integral.

21. A humidifying apparatus comprising:

a housing;

a tray for holding water, the tray disposed in proximity to the housing; and a heating element, the heating element positioned at least partially within the tray, the heating element including a mounting portion, a leg portion and a foot portion, the mounting portion being coupled to the housing, the leg portion having an upper end and a lower end, the mounting portion being coupled to the upper end of the leg portion, the leg portion extending substantially vertically downward from the mounting portion, the foot portion being coupled to the lower end of the leg portion and extending substantially horizontally therefrom, the foot portion including a bottom surface and a perimeter when viewed from above, the bottom surface including a nadir, the bottom surface being at least one of curved and slanted upward from the nadir to the perimeter of the heating element.

22. A humidifying apparatus as defined by claim 21, wherein the leg portion is elongated and separates the mounting portion and the foot portion.

23. A humidifying apparatus as defined by claim 21, wherein the foot portion of the heating element includes an upper surface and a lower surface, the foot portion being shaped such that a line from the upper surface to the lower surface must pass through the perimeter of the heating element.

24. A humidifying apparatus as defined by claim 21, wherein the mounting portion of the heating element includes a threaded portion, the threaded portion being removably coupled to the housing.

25. A humidifying apparatus as defined by claim 21, further comprising a gasket, wherein the mounting portion of the heating element includes a cylindrical portion and a flange, the flange being coupled to the cylindrical portion and extending substantially vertically downward therefrom, the gasket being disposed around the cylindrical portion above the flange, the gasket providing a seal between the heating element and the housing when the heating element is coupled thereto.

26. A humidifying apparatus as defined by claim 25, wherein the housing includes a side cross-sectional profile, and wherein the gasket includes an upper annular ring, a central annular ring, a lower annular ring, and a side cross-sectional profile, the upper annular ring having a perimeter, the central annular ring being coupled to the upper annular ring and having a perimeter which is less than the perimeter of the upper annular ring, the lower annular ring being coupled to the central annular ring and having a perimeter which is substantially the same as the perimeter of the upper annular ring, each of the annular rings having an inner circumference, the inner circumference of the annular rings being substantially the same and defining a vertical conduit extending through the gasket having a substantially constant diameter through which the cylindrical portion of the heating element is disposed, the annular rings coupled such that the perimeters of the annular rings are substantially concentric when viewed from above, the side cross-sectional profile of the gasket substantially conforming to the side cross-sectional profile of the housing surrounding the heating element.

27. A humidifying apparatus as defined by claim 26, wherein the upper annular ring, the central annular ring and the lower annular ring are integral.

28. A heating element for use in a humidifying apparatus comprising:

a mounting portion, a leg portion, the leg portion having an upper end and a lower end, the mounting portion being coupled to the upper end of the leg portion, the leg portion extending substantially vertically downward from the mounting portion; and a foot portion, the foot portion being coupled to the lower end of the leg portion and extending substantially horizontally therefrom, the leg portion being elongated and separating the mounting portion and the foot portion.

29. A heating element for use in a humidifying apparatus as defined by claim 28, wherein the foot portion includes an upper surface, a lower surface and a perimeter viewed from above the foot portion, the foot portion being shaped such that a line from the upper surface to the lower surface must pass through the perimeter of the heating element.

30. A heating element for use in a humidifying apparatus as defined by claim 28, wherein the foot portion includes a bottom surface, the bottom surface being substantially convex.

31. A heating element for use in a humidifying apparatus as defined by claim 28, wherein the foot portion of the heating element includes a bottom surface, a right side and a left side, the bottom surface being at least one of slanted upward and slanted downward from the left side to the right side.

32. A heating element for use in a humidifying apparatus as defined by claim 28, wherein the foot portion of the heating element includes a bottom surface, a toe portion and a heel portion, the bottom surface being at least one of slanted upward and slanted downward from the toe portion to the heel portion.

33. A heating element for use in a humidifying apparatus as defined by claim 28, wherein the foot portion includes a bottom surface and a perimeter when viewed from above, the bottom surface including a nadir, the bottom surface being curved upward from the nadir to the perimeter of the heating element.

34. A heating element for use in a humidifying apparatus as defined by claim 28, wherein the mounting portion of the heating element includes a threaded portion such that the heating element can be removably coupled to the humidifying apparatus.

35. A heating element for use in a humidifying apparatus comprising:

a mounting portion;

a leg portion, the leg portion having an upper end and a lower end, the mounting portion being coupled to the upper end of the leg portion, the leg portion extending substantially vertically downward from the mounting portion; and a foot portion, the foot portion being coupled to the lower end of the leg portion and extending substantially horizontally therefrom, the foot portion including an upper surface, a lower surface and a perimeter viewed from above, the foot portion being shaped such that a line from the upper surface to the lower surface must pass through the perimeter of the heating element.

36. A heating element for use in a humidifying apparatus as defined by claim 35, wherein the leg portion is elongated and separates the mounting portion and the foot portion.

37. A heating element for use in a humidifying apparatus as defined by claim 35, wherein the foot portion includes a bottom surface, the bottom surface being substantially convex.

38. A heating element for use in a humidifying apparatus as defined by claim 35, wherein the foot portion of the heating element includes a bottom surface, a right side and a left side, the bottom surface being at least one of slanted upward and slanted downward from the left side to the right side.

39. A heating element for use in a humidifying apparatus as defined by claim 35, wherein the foot portion of the heating element includes a bottom surface, a toe portion and a heel portion, the bottom surface being at least one of slanted upward and slanted downward from the toe portion to the heel portion.

40. A heating element for use in a humidifying apparatus as defined by claim 35, wherein the foot portion includes a bottom surface, the bottom surface including a nadir, the bottom surface being curved upward from the nadir to the perimeter of the heating element.

41. A heating element for use in a humidifying apparatus as defined by claim 35, wherein the mounting portion includes a threaded portion such that the heating element can be removably coupled to the humidifying apparatus.

42. A heating element for use in a humidifying apparatus comprising:

a mounting portion;

a leg portion, the leg portion having an upper end and a lower end, the mounting portion being coupled to the upper end of the leg portion, the leg portion extending substantially vertically downward from the mounting portion into the water; and a foot portion, the foot portion being coupled to the lower end of the leg portion and extending substantially horizontally therefrom in the water, the foot portion including a bottom surface and a perimeter when viewed from above, the bottom surface including a nadir, the bottom surface being at least one of curved and slanted upward from the nadir to the perimeter of the heating element.

43. A heating element for use in a humidifying apparatus as defined by claim 42, wherein the leg portion is elongated and separates the mounting portion and the foot portion.

44. A heating element for use in a humidifying apparatus as defined by claim 42, wherein the foot portion includes an upper surface and a lower surface, the foot portion being shaped such that a line from the upper surface to the lower surface must pass through the perimeter of the heating element.

45. A heating element for use in a humidifying apparatus as defined by claim 42, wherein the mounting portion includes a threaded portion such that the heating element can be removably coupled to the humidifying apparatus.

* * * * *